United States Patent [19]

Niemi

[11] Patent Number: 4,720,049

[45] Date of Patent: Jan. 19, 1988

[54] FEEDER DEVICE FOR PRESSURE CHAMBER GRINDER

[75] Inventor: Jouko Niemi, Pirkkala, Finland

[73] Assignee: Oy Finnpulva AB, Finland

[21] Appl. No.: 876,868

[22] PCT Filed: Oct. 11, 1985

[86] PCT No.: PCT/FI85/00082

§ 371 Date: Jun. 5, 1986

§ 102(e) Date: Jun. 5, 1986

[87] PCT Pub. No.: WO86/02287

PCT Pub. Date: Apr. 24, 1986

[30] Foreign Application Priority Data

Oct. 12, 1984 [FI] Finland ..... 844028

[51] Int. Cl.[4] ..... B02C 19/06

[52] U.S. Cl. ..... 241/39; 241/5

[58] Field of Search ..... 241/1, 5, 39, 40, 301, 241/62, 28, 280, 282, 281, 34, DIG. 14, 101.2

[56] References Cited

U.S. PATENT DOCUMENTS 1,099,557 6/1914 Lorenz et al. ..... 241/DIG. 14 X
4,333,613 6/1982 Haikkala ..... 241/DIG. 14 X
4,422,579 12/1983 Niemi ..... 241/39

FOREIGN PATENT DOCUMENTS

WO8403455 9/1984 PCT Int'l Appl. .

*Primary Examiner*—Mark Rosenbaum
*Attorney, Agent, or Firm*—McGlew and Tuttle

[57] ABSTRACT

The present invention is concerned with a device for feeding a material to be ground into a pressure chamber grinder provided with an equalizing tank (1), in which said equalizing tank (1) there is substantially the same pressure as in the pre-grinding part of the grinder, with which said pre-grinding part the equalizing tank (1) communicates via screw conveyor. The said device is installed in the top portion of the equalizing tank. The device is characterized in that it comprises a substantially vertical, conical feeder chamber (4), whose volume is, at the maximum, about one quarter of the volume of the equalizing tank (1) and at whose top end there is a feed opening (2) and, at the bottom end, an exhaust opening (3) larger than the feed opening (2); valve members (5, 6) arranged in the said openings (2, 3) and having diameters corresponding to the said openings (2, 3, respectively), the said valve members (5, 6) being provided with elastic closing members, operating in the way of an annular muscle for closing and opening the said openings (2, 3); a gas feed pipe (8) passing into the top portion of the feeder chamber (4) and provided with a valve (7) for the generation of a pressure impact in the top end of the feeder chamber (4), and a gas-removing pipe (10) provided with a valve (9), for lowering the pressure prevailing in the feeder chamber.

7 Claims, 1 Drawing Figure

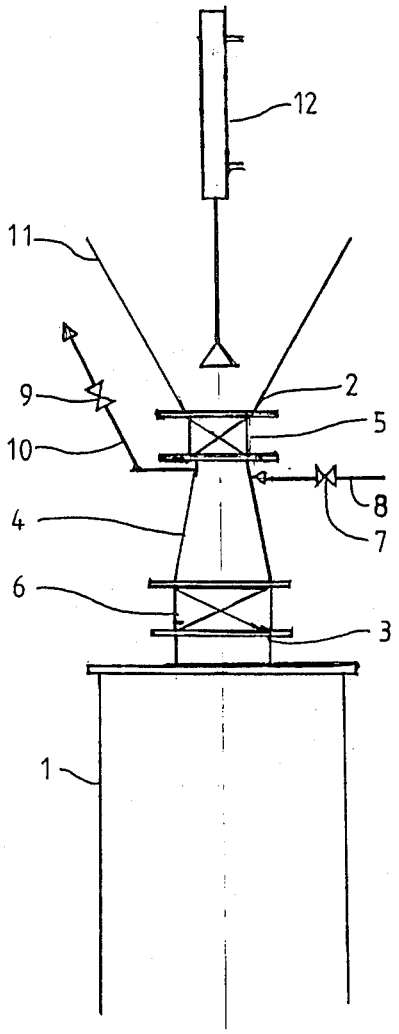
12
11
9
10
2
5
8
7
4
6
3
1

FEEDER DEVICE FOR PRESSURE CHAMBER GRINDER

The present invention is concerned with a device for feeding the material to be ground into a pressure chamber grinder provided with an equalizing tank, in which said equalizing tank there is substantially the same pressure as in the pre-grinding part of the grinder, with which said pre-grinding part the equalizing tank communicates via a screw conveyor. The device concerned is installed in the top portion of the equalizing tank.

As a feeder device for pressure chamber grinders, usually a so-called plug feeder is used, by means of which the material to be ground is fed into the equalizing tank as a gas-tight plug, as is described, e.g., in the International Patent Application No. PCT/FI84/00021. The ejector feeder devices, which are commonly used in conventional jet grinder devices, are not at all suitable for being used in pressure chamber grinders, owing to the very high operating pressures in the latter. On the contrary, a plug feeder is excellently suitable for this purpose in the case that the properties of the material to be ground are such that the material can be compressed into a gas-tight plug. There are, however, also many such materials as would be otherwise well suitable for grinding in a pressure chamber grinder but as cannot be compressed into a gas-tight plug. Such materials are, e.g., granular materials and kernels of grain.

The object of the present invention is also to permit the grinding of materials of this type in a pressure chamber grinder, in view of the good energy economy and excellent grinding properties of the said grinder. This can be accomplished by means of a device in accordance with the invention, which is characterized in that the device comprises a substantially vertical, conical feeder chamber, whose volume is, at the maximum, about one quarter of the volume of the equalizing tank and at whose top end there is a feed opening and, at the bottom end, an exhaust opening layer than the feed opening; valve members arranged in said openings and having diameters corresponding to the said openings, the said valve members being provided with elastic closing members, operating in the way of an annular muscle for closing and opening the said openings; a gas feed pipe passing into the top portion of the feeder chamber and provided with a valve, for the generation of a pressure impact in the top end of the feeder chamber, and a gas-removing pipe provided with a valve, for lowering the pressure prevailing in the feeder chamber.

An object of the invention is to provide an improved feeding device for feeding granular material to be ground into a pressure chamber grinder equalizing tank which includes a feeder having a feeder chamber with one end connected to the equalizing tank and the exhaust opening adjacent this one end and having an exhaust valve for opening and closing the exhaust opening and in which the feeder chamber has an opposite end with a feed opening having a valve in the feed opening with each of the valves having an elastic closing member defining an annular muscle for closing and opening the valves and with a gas feed line extending into the top of the feeding chamber having a gas feed control valve for controlling the gas pressure impact of gas flowing into the feed chamber and a gas removing line connected into the feed chamber with a gas outlet valve lowering the pressure in the feed chamber.

A further object of the invention is to provide a feeding device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWINGS

The only FIGURE of the drawings is a schematic elevational view of a feeding device for feeding granular material to be ground to a pressure chamber grinder having an equalizer tank.

GENERAL DESCRIPTION OF THE PREFERRED EMBODIMENTS

The feeder device concerned comprises a substantially vertical conical feeder chamber 4, which is installed in the top portion of the equalizing tank 1 of the pressure chamber grinder, which is provided with a feed opening 2 and an exhaust opening 3. The volume is at the maximum about a quarter of the volume of the feeder chamber 4 of the equalizing tank 1. The diameter of the exhaust opening 3 is larger than that of the feed opening 2. At these openings 2, 3, valve members 5, 6 are mounted whose diameters correspond to the openings 2 and 3, respectively. The valve members 5 and 6 are provided with elastic closing members operating in the way of an annular muscle, for the purpose of closing and opening the respective openings 2 and 3. A gas feed pipe 8 provided with a valve 7 is passed into the top portion of the feeder chamber 4 so as to generate a pressure impact. Also, a gas-removing or gas outlet pipe 10 provided with a valve 9 is passed from the top portion of the feeder chamber 4 so as to lower the pressure in the feeder chamber 4 to the pressure of the surrounding atmosphere.

A prerequisite for the possibility of using such a valve feeder device is that the pressure chamber grinder system is provided with an equalizing tank 1, in which substantially the same pressure prevails as in the pre-grinding part of the grinder and in which the material to be ground is made loose, e.g., by means of a rotor before it is fed into the pre-grinding part by means of a screw conveyor. In order that a good grinding result could be achieved, it is, viz., required that the material to be ground is fed as a very uniform flow into the pre-grinding chamber.

The feed opening 2 of the device is preferably provided with a feed funnel 11 for receiving the material to be ground, e.g., from the conveyor belt (not shown) or from a storage silo. In order to determine the batch of material fed, it is possible, e.g., to provide weighing devices underneath the equalizing tank 1, which indicate the quantity of material present in the equalizing tank. In addition to this, it is, e.g., possible to install weighing devices so as to detect the quantity of material present in the storage silo. In order to intensify the filling of the feeder chamber 4, a pushing piston 12 which operates vertically and which is placed in line with the feed opening of the device is favourably installed above the feed funnel 11, which said piston 12 is arranged so as to push and to compact the material to be ground into the feeder chamber 4. The use of a pushing piston 12 is advantageous in particular when the material to be ground has a very low bulk density. Since the weight of the material batch fed into the feeder chamber 4 can be increased thereby, the quantity of working gas required to detach the material and the number of times of actuation of the valves are reduced considerably per ton of material.

The filling of one batch of material into the equalizing tank 1 takes place as follows:

The exhaust valve 6 of the device and the valves 7, 9 of both of the gas pipes 8, 10 are kept closed; only the feed valve 5 of the device is kept open. The material to be ground is fed into the feed funnel 11 of the device, and it is allowed to flow from the feed funnel 11 into the feeder chamber 4 of the device. In order to intensify the filling, the pushing piston 12 of the device is preferably arranged so as to perform a few pushing strokes each time when a new batch of material has been transferred into the feed funnel 11. When the feeder chamber 4 is filled ready, the feed valve 5 is closed and the exhaust valve 6 is opened, whereupon the valve 7 in the gas-feed pipe 8 is opened so as to produce a pressure impact in the top portion of the feeder chamber 4. By the effect of the pressure impact, the batch of material present in the feeder chamber is detached and falls down into the equalizing tank 1. Owing to the conical shape of the feeder chamber 4, the transfer of the material into the equalizing tank 1 takes place immediately, because there are no choking portions between the feeder chamber 4 and the equalizing tank 1, but the flow channel formed by the feeder chamber 4 and by the exhaust valve 6 becomes substantially all the time wider when moving towards the equalizing tank 1. If the diameter of the exhaust valve 6 was equal to that of the feed valve 5, a choking portion similar to a bottle-neck would be formed in the bottom portion of the feeder chamber, which would hamper and, in the worst case, completely block the transfer of material into the equalizing tank 1, in particular if the material to be ground is readily clodding. After the feeder chamber 4 has been emptied, the exhaust valve 6 and the valve 7 of the gas-feed pipe 8 are closed and the valve 9 of the gas-removing pipe 10 is opened in order to lower the pressure prevailing in the feeder chamber 4 to the level of the pressure of the surrounding atmosphere, whereupon the valve 9 is closed and the feed valve 5 is opened in view of receiving a new batch of material.

As was already stated above, it is a prerequisite for the obtainment of a good grinding result that the feed of material by means of a screw conveyor into the pre-grinding chamber must be kept as uniform as possible. Moreover, a relatively constant gas pressure must be maintained in the pre-grinding chamber and also in the equalizing tank. By selecting the size of the feeder chamber 4 such that its volume is no more than about one quarter of the volume of the equalizing tank 1, it is made sure that the pressure impacts produced in the feeder chamber 4 do not have a significant effect on the pressure prevailing in the equalizing chamber.

In order that a wear-resistant feeder device reliable in operation could be provided, both the feed valve (5) and the exhaust valve (6) of the device must be of a type that has an elastic closing member operating in the way of an annular muscle. In such a valve, which is usually called a premaflex valve, no major wear occurs. On the contrary, a closing valve of an ordinary type would be worn out and become unusable in a few hours in a feeder device of this type.

The gas-feed pipe 8 is preferably connected to a gas source which has a gas colder than the working gas and whose pressure is about 0.5 bar higher than the pressure prevailing in the equalizing tank. Cold gas is fed into the feeder chamber 4 in order that the high temperature prevailing in the pressure chamber grinder should not be transferred into the feed funnel and into the storage silo, which said high temperature would have a deterimental effect on the entire feed process. By using a positive pressure of 0.5 bar, a sufficiently high pressure impact is produced, which does, however, not have a significant effect on the pressure prevailing in the equalizing tank. By connecting the gas-feed pipe 8 to the working-gas line of the pressure chamber grinder before the superheater, a gas of a suitable temperature and pressure is obtained.

If the pressure chamber grinder equipment includes a storage silo, the gas-removing pipe 10 can be connected advantageously to the bottom part of the silo, whereby the gas discharge taking place from the feeder chamber 4 at the end of each feeding step is utilized for loosening the material in the silo.

All the operations of the feeder device are preferably controlled by means of a programmed logic unit, which receives impulses from a sensor placed in the feeder chamber 4 and arranged so as to detect when the feeder chamber 4 is empty, from a sensor placed in the equalizing tank 1 at a predetermined height and arranged so as to detect the upper level of the material quantity present in the equalizing tank 1, which said level must not be higher than the said height, as well as from a sensor placed in the working-gas line of the pressure chamber grinder and arranged so as to detect when working gas is being passed into the pressure chamber grinder. Thereat it is preferable that the exhaust valve (6) and the feed valve (5) operate hydraulically or pneumatically. A new filling step starts when the feeder chamber 4 is empty, the quantity of material in the equalizing tank does not exceed the predetermined level, and working gas is being passed into the pressure-chamber grinder, i.e. the pressure chamber grinder is in operation.

To keep the friction between the material to be ground and the wall faces of the feeder chamber 4 as low as possible, the said wall face may be coated, e.g., with a special paint or with teflon, or be lined, e.g., with a noble-metal layer.

What is claimed is:

1. A pressure chamber grinder equipment comprising a pressure chamber grinder equalizing tank, a substantially vertical, control feeder chamber enlarging downwardly and having an inlet opening at its upper end and an exhaust opening at its bottom end, said exhaust opening communicating with said equalizing tank, a valve member in the inlet opening and the exhaust opening, each having the same diameters as the corresponding openings and each valve member being provided with an elastic closing member defining an annular muscle for closing and opening the openings, a gas feed pipe passing into the top portion of the feeder chamber, a feed valve for the generation of a pressure impact and a top end of said feed chamber, a gas removing pipe, a gas discharge valve for lowering the pressure prevailing in said feed chamber, the volume of said equalizing tank being at least four times as large as the volume of said feeder chamber.

2. A feeding device for feeding granular material to be ground, comprising a pressure chamber grinder equalizing tank, a feeder having a feeder chamber with one end connected to said equalizing tank, an exhaust opening adjacent said one end having an exhaust valve for opening and closing the exhaust opening, said feeder chamber having an opposite end with a feed opening, a feed valve in said feed opening, said feed valve and said exhaust valves each having elastic closing members defining an annular muscle for closing and opening said valves, a gas feed line passing into the top of said feed chamber, a gas feed control valve in said gas feed line for controlling the gas pressure impact of gas flowing into said feed chamber, and a gas removing line connected into said feeding chamber, and a gas outlet valve in said gas removing line for lowering the pressure in said feed chamber.

3. A feeding device according to claim 2, wherein said gas feed line comprises a hold gas feed line having a pressure of about 0.5 bar higher than the pressure prevailing in said equalizing tank.

4. A feeding device according to claim 2, wherein said feed chamber has an interior wall with a friction-reducing surface.

5. A feeding device according to claim 2, including a feed funnel connected to said feeder chamber adjacent said opposite end and including a pushing piston arranged over said feeding funnel for feeding material into said funnel.

6. A feeding device according to claim 2, wherein said feed valve and said exhaust valve include hydraulic operating means.

7. A feeding device according to claim 2, including pneumatic means for operating said feed valve and said exhaust valve.

* * * * *